US006443453B1

(12) United States Patent
Wallice

(10) Patent No.: US 6,443,453 B1
(45) Date of Patent: Sep. 3, 2002

(54) PERFORMANCE REVIEW GAME

(76) Inventor: Patricia Anne Wallice, 3710 27th Pl. West, #203, Seattle, WA (US) 98199

( * ) Notice: Subject to any disclaimer, the term of this patent is extended or adjusted under 35 U.S.C. 154(b) by 0 days.

(21) Appl. No.: 09/538,692

(22) Filed: Mar. 30, 2000

(51) Int. Cl.[7] ..... A63F 3/00

(52) U.S. Cl. ..... 273/243; 273/292

(58) Field of Search ..... 273/236, 243, 273/248, 249, 242, 292

(56) References Cited

U.S. PATENT DOCUMENTS 1,208,992 A * 12/1916 Leonard
3,926,438 A * 12/1975 Breslow
4,003,577 A * 1/1977 Bolach
4,095,799 A * 6/1978 Stringer
4,201,388 A * 5/1980 Cantelon
4,501,425 A * 2/1985 Alvarado
4,706,960 A * 11/1987 Nowacki
5,503,399 A * 4/1996 Honeywill
6,142,472 A * 11/2000 Kliebisch

* cited by examiner

*Primary Examiner*—Benjamin H. Layno
*Assistant Examiner*—Vishu K Mendiratta

(57) ABSTRACT

An office performance review game, comprising a plurality of game pieces with each piece representing a player (26); a game board (12); chance device for controlling movement of game pieces (24), Trek boss comment cards (14), Track boss comment cards (16), twenty-point cards (18), and ten-point cards (20). The game board contains two paths to a home space, each path divided into a plurality of spaces. Each of the paths represents a different quality of job performance review. One path is called the Trek path (28) and the second is called the Track path (34). Players throw a die to determine which path they will travel. Players either read performance review comments that are inserted in spaces of a traveling path and select a card containing the value of the comment or they select cards that contain a performance review comment and comment value. Either way, they collect a "hand" of cards that together determine a performance review. Players play the game in order to obtain performance review comments that will result in a high performance review level. At game end, players show their hand and reveal their performance review.

16 Claims, 15 Drawing Sheets

(BORDER OF GAME BOARD)

20-PT CARD

TRACK 10-PT CARD

ONE-PATH VERSION

ONE PATH VERSION

ONE PATH VERSION

ONE-PATH VERSION
(ALL BOSS FACES)

ONE PATH VERSION (ALL BOSS FACES)

ONE-PATH VERSION
(no boss comment cards)

PERFORMANCE REVIEW GAME

CROSS-REFERENCE TO RELATED APPLICATIONS

Not applicable.

BACKGROUND—FIELD OF INVENTION

This invention relates to board games, specifically to a performance review board game.

BACKGROUND—DESCRIPTION OF PRIOR ART

There are many board games in the prior art that include game boards having one or more paths, a game piece for each player to advance along the pathways, a chance device, and one or more sets of cards each containing information and questions relating to play and game topic. Such games are played for both amusement and learning, and cover a variety of specialized topics.

There is a need for a board game on a well-known topic that is fun and instructional, and that has wider appeal and value to many more people. The topic of job performance reviews as given to millions of office workers in companies and organizations on a regular basis has the potential to meet these needs. I could not find reference to a board game that has job performance reviews as its topic, either as education, fun, or both.

SUMMARY

A performance review board game including a game board having at least one traveling path, a plurality of game pieces, a plurality of game cards, and a chance device, and during the play of which players assume the role of employees and receive job performance review comments and associated values from bosses, which values when combined will yield a total value that may be compared to prescribed performance review levels to yield a final performance review.

OBJECTS AND ADVANTAGES

Accordingly, several objects and advantages of the present invention are:

a) to provide a board game relating to the job performance reviews that millions of office workers experience on a regular basis during their working lives b) to provide a means by which families or groups can experience a job performance review together in a fun and also educational manner that is based on those actually conducted by bosses in companies and organizations c) to provide a board game in which travel across a game board to a home space constitutes a performance review experience similar to that of sitting in a boss's office and actually getting a job performance review d) to familiarize younger players who haven't entered the workplace with elements of a real performance review experience and help them understand this workplace tool e) to provide a performance review board game that can serve as a teaching tool f) to provide a performance review board game that showcases boss power by revealing the source of performance review comments prominently in game design and concept g) to provide a performance review board game containing familiar and recognizable boss performance review comments that are drawn from real life situations h) to provide a performance review board game in which the phrasing of boss comments can demonstrate differences in boss management skill and temperament i) to provide a performance review board game in which boss performance review comments may easily be customized to fit specific job fields, specific jobs, or to include specific workplace protocol j) to provide a performance review board game that is easy to use and simple to learn k) to provide a performance review board game that may be produced easily and inexpensively and made available to all economic levels of the buying public Further objects and advantages of my invention will become apparent from a consideration of the drawings and ensuing description.

DRAWING FIGURES—PREFERRED EMBODIMENT

In the drawings, closely related figures have the same number but different alphabetic suffixes.

Reference Numerals in Drawings—Preferred Embodiment

Figure 1A:
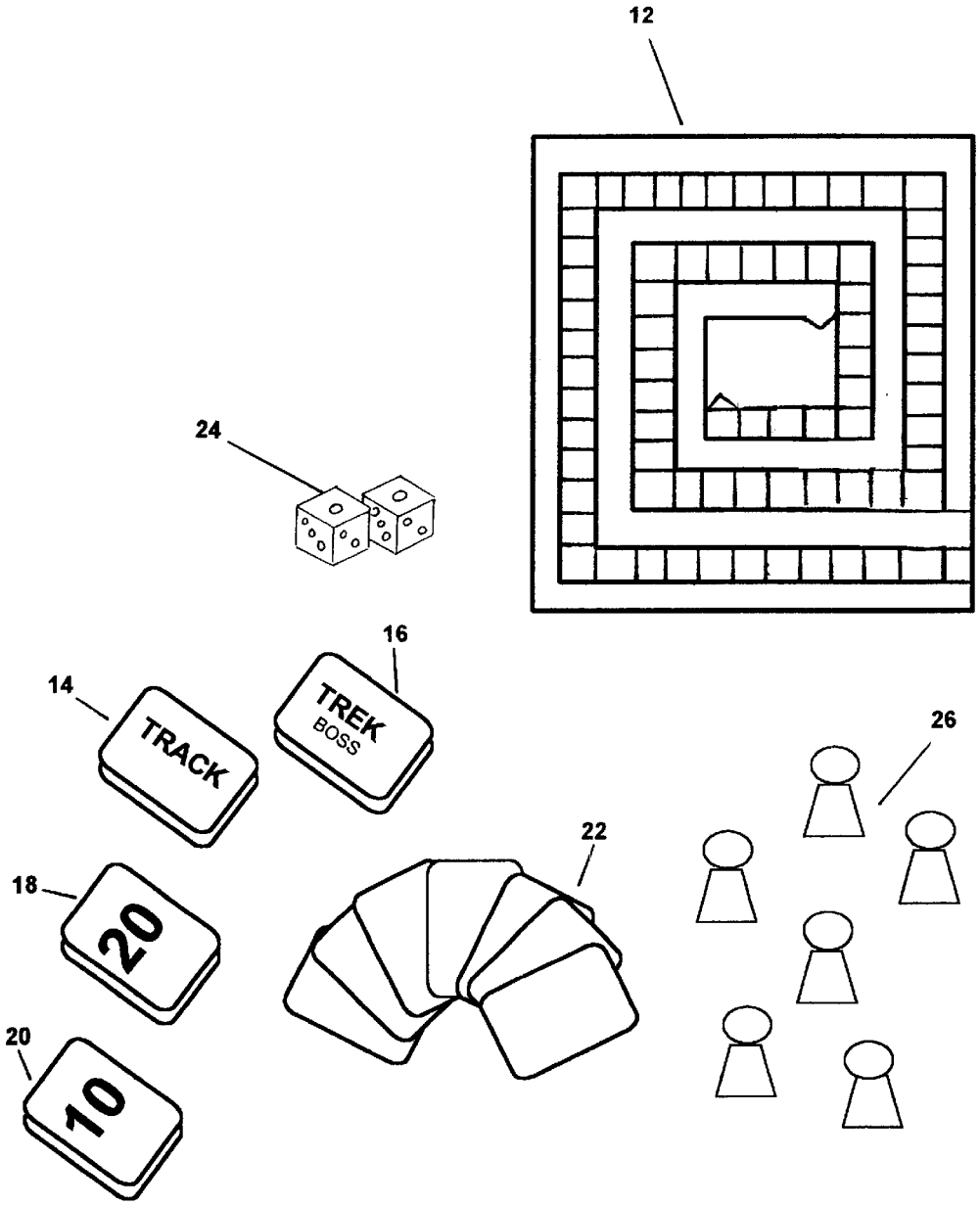
FIG. 1A is a general view of the board game, game cards, dice, and game pieces for playing the subject game.

Game board 12
Track boss comment cards 14
Trek boss comment cards 16
Twenty-point cards 18
Ten-point cards 20
"Hand" holding style 22
Dice 24
Game pieces 26
Trek path 28
Trek office 30

Trek last space 32
Track path 34
Track office 36
Track last space 38
Home space 40
Board border 42

DRAWING FIGURES—ONE PATH VERSION

Figure 8A:
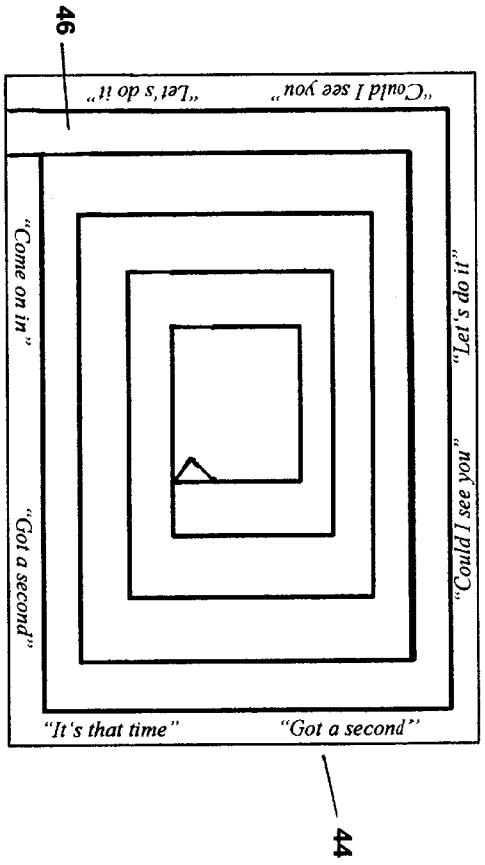
Figure 8B:
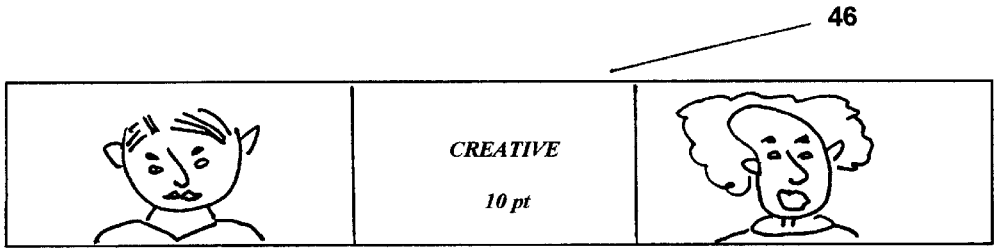

FIGS. 8A to 8B are a general view of a one-path game board and an enlarged view of a section of the one path.

Figure 8C:
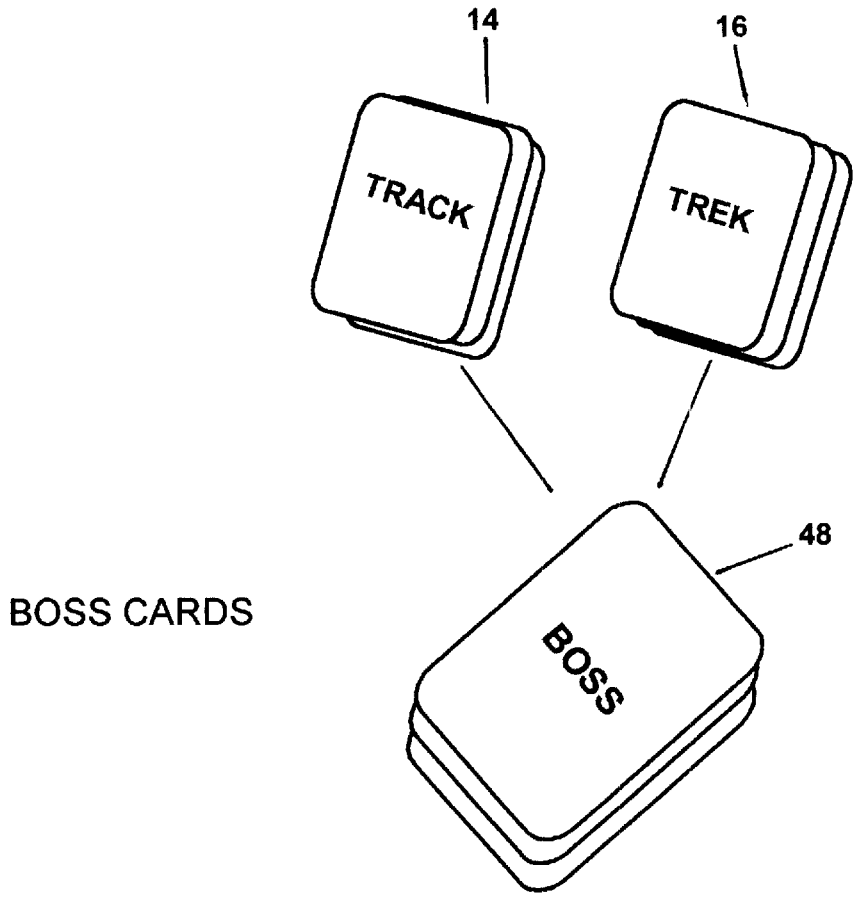

FIG. 8C is a view of a single stack of game cards called Boss comment cards.

Figures 8D, 8E:
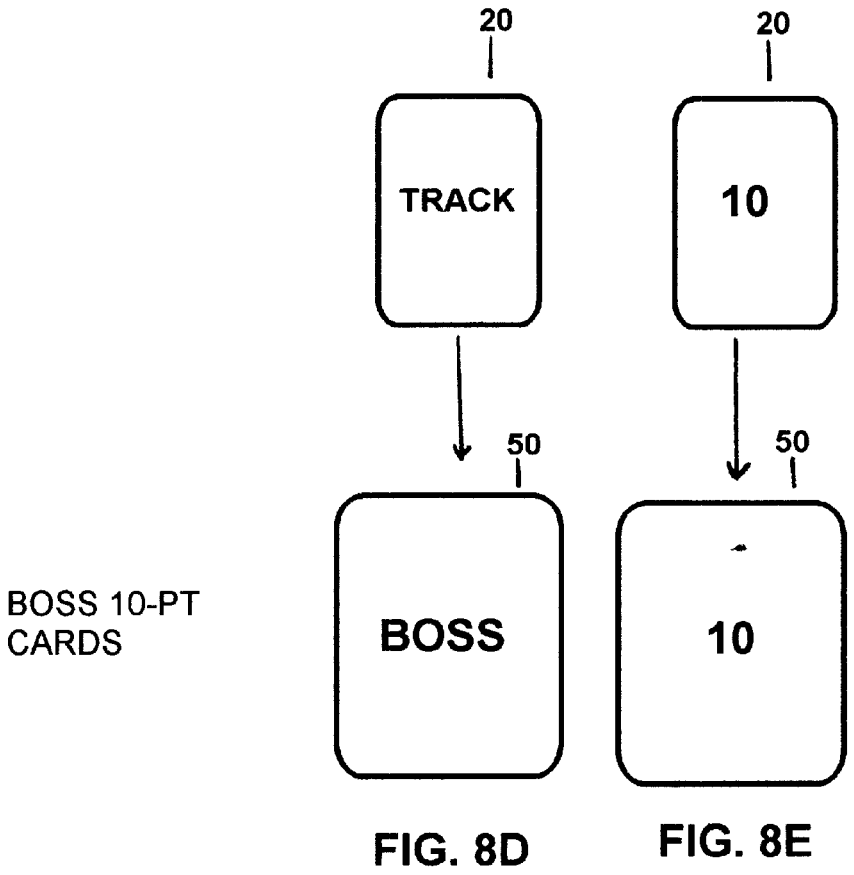

FIG. 8D to 8E are views of both sides of a 10-point comment value card.

Reference Numerals in Drawings—One Path Version

Game board 44
Single path and path section 46
Single stack of Boss comment cards 48
Ten-point cards, both sides 50

DRAWING FIGURES—ONE PATH VERSION (ALL BOSS FACES)

Figure 9A:
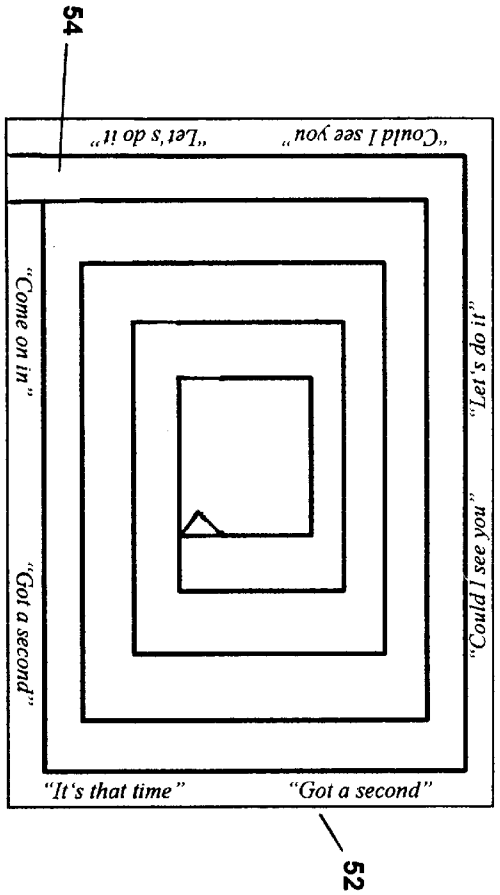
Figure 9B:
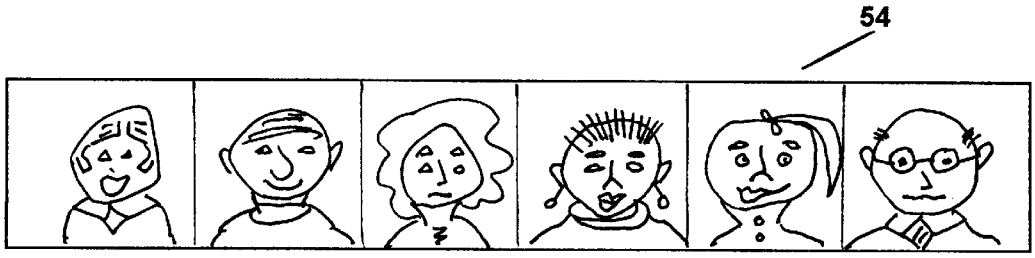

FIGS. 9A to 9B are a view of the one-path game board and an enlarged view of a path section featuring boss images in each traveling space.

Figure 9C:
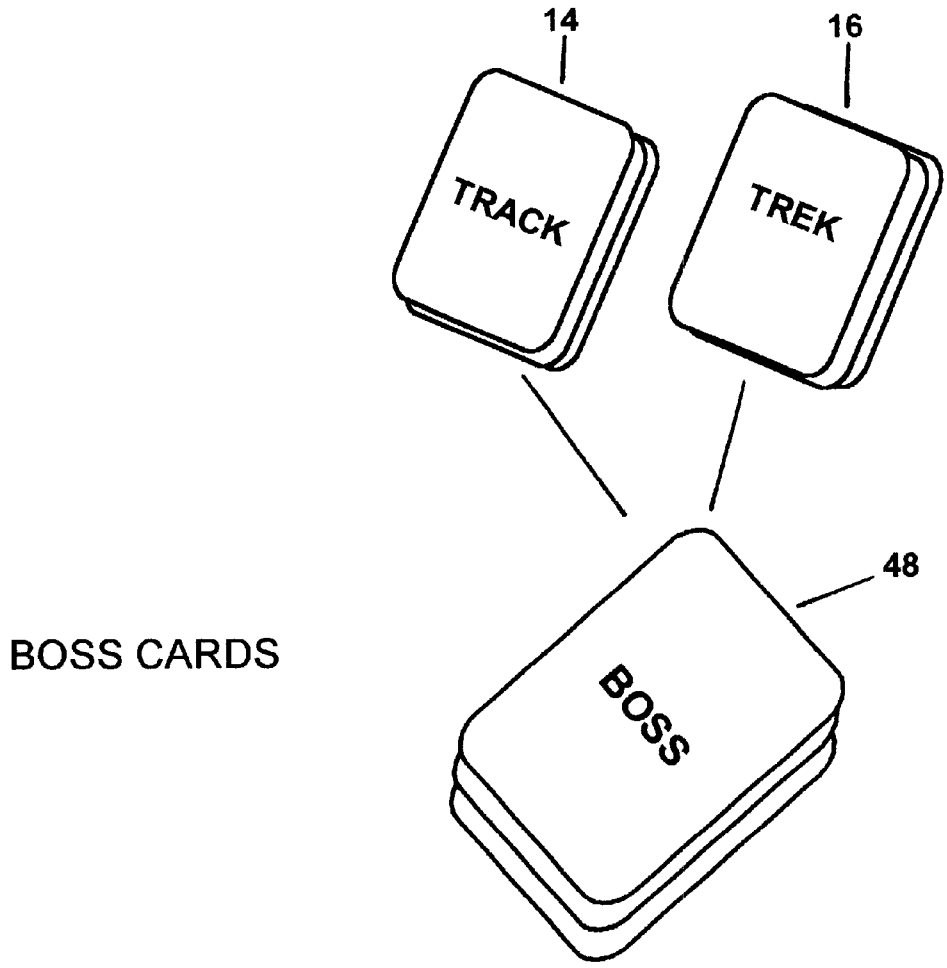

FIG. 9C is a view of a single stack of boss comment cards.

Reference Numerals in Drawings—One Path Version (All Boss Faces)

Game board 52
One path and path section 54
Single stack of Boss comment cards 48

DRAWING FIGURES—ONE PATH VERSION (NO BOSS COMMENT CARDS)

Figure 10A:
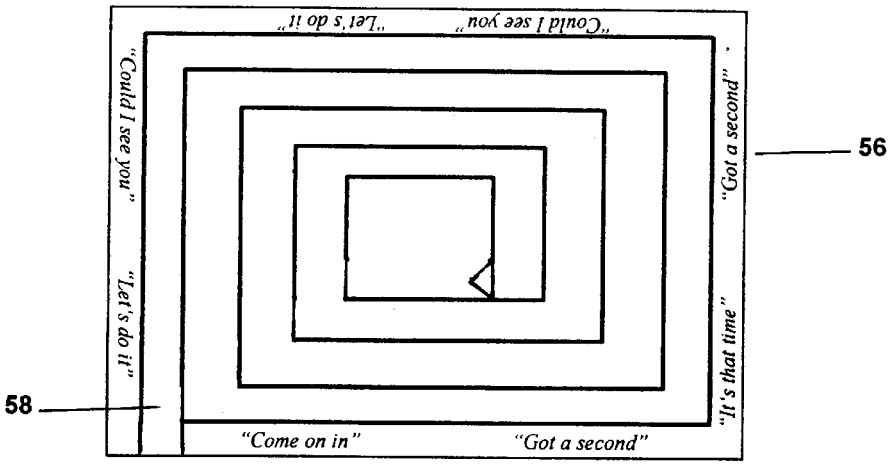
Figure 10B:
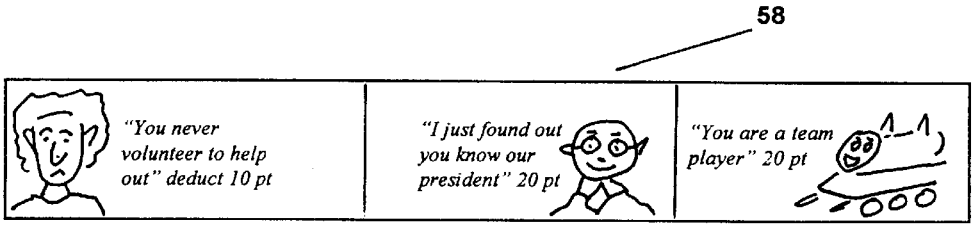

FIGS. 10A to 10B are views of the one-path game board and an enlarged view of a path section featuring comments and comment values in each playing space.

Reference Numerals in Drawings—One Path Version (No Boss Comment Cards)

Game board 56
One path and path section 58

DESCRIPTION OF INVENTION—PREFERRED EMBODIMENT

A preferred embodiment of my board game comprises a plurality of components in their broadest context. Such components include a game board, game pieces, dice, and game cards. A generalized representation of the game board, game pieces, dice, game cards, and a view of a "hand" of game cards are shown in FIG. 1A.

The game board 12 is rectangular, planar, and foldable. The game board contains two paths for players to move along. One is called the Trek path 28 and the other is called the Track path 34.

The Trek path is longer and holds the outer position. Each path bears images and indicia. Each has a distinct starting point which is placed in the border 42 of the game board. The starting point for the Trek path is the Trek Office 30. The starting point for the Track path is called the Track Office 36. The last space 32 of the Trek path contains a directional arrow pointing to the Home space 40. The last space 38 of the Track path contains a directional arrow pointing to the Home space 40.

The Trek path 28 is divided into 37 spaces. Each of these spaces contains an image of a boss.

The Track path 34 is divided into 33 spaces. Eighteen of the spaces contain the image of a fast moving vehicle symbolizing motion and bearing a positive performance review comment and the words "Ten points". Fifteen of the Track spaces contain the word "RISK". The following is an ordered list of the contents of the Track path spaces:

Track Playing Spaces
Leader 10 points
2. RISK
3. Computer Whiz 10 points
4. RISK
5. Articulate 10 points
6. RISK
7. Professional with all 10 points
8. RISK
9. Enthusiastic 10 points
10. RISK
11. Curious and questioning 10 points
12. RISK
13. Creative 10 points
14. RISK
15. Multiple skills 10 points
16. RISK
17. Mentor 10 points
18. RISK
19. Positive 10 points
20. Ethical 10 points
21. Eager to learn 10 points
22. RISK
23. RISK
24. Shares knowledge 10 points
25. Fair 10 points
26. RISK
27. RISK
28. RISK
29. Action oriented 10 points
30. Innovative 10 points
31. Breadth of knowledge 10 points
32. Team player 10 points
33. RISK The outer edge of the board 42 is an area or border on which game pieces 26 do not move. Rather this area contains typical and familiar oral expressions of greeting or opening remarks a boss might use at the beginning of a performance review in his office.

The center Home space 40 is square shaped and located approximately in the center of the game board. The words "performance Review" are represented along each side of the square. The standards for measuring the performance of the game players are stated in the interior of the square as follows:

Superior 90+
Exceeds 80–89
Meets 70–79
Doesn't Meet 60–69
Fired Below 60

Game pieces are light and stable shapes in the form of little human beings 26. They may each be in a different color so players can easily relate to their piece.

Dice are standard, with six sides, each side bearing one of the numbers 1 to 6 24.

Game cards. There are two 60-card stacks that are used as a means of delivering boss performance review comments and comment values, each stack associated with a particular path. One stack is called Track boss comment cards 14. The second stack is called Trek boss comment cards 16. There is a third stack that contains 20-point cards 18. There is a fourth stack of 10-point cards 20. All cards are of a size suitable for holding hand style 22.

The Trek boss comment cards contain a variety of boss performance review comments and values. The majority of these comments are not task-specific, are negative, or are unprogressive. The Track boss comment cards contain a variety of boss comments and values, the majority of which are task specific, concrete, and progressive. The following is a list of the Trek boss comments and Track boss comments:

Game Card Comments—Trek

"We think you are always so cheerful" 5
"You always keep your desk neat." 5
"You have perfect timekeeping" 5
"I really enjoy working with you" 5
"We know you try hard." 5
"We sure like the way you take care of the plants." 5
"Everybody thinks you are a fun person." 5
"We rarely need to supervise you." 5
"You seem to be trying to improve yourself." 5
"You always keep your booth so neat and attractive" 5
"You re quiet and conscientious" 5
"I think you need minimal supervision" 5
"You are a very reliable person" 5
"I personally think you have a real nice little personality." 5
"You always offer to help out and that's very good." 5
"You are a very nice person." 5
"We always enjoy those goodies you bring in." 5
"You always get in on time." 5
"You are doing your job." 5
"Everybody says you have a very good sense of humor" 5
"You are a nice person" 5
"We like the way you participate" 5
"Everybody says you are efficient" 5
"You are always doing your job" 5
"You are doing fine" 5
"You surprised us." Go to track or 20 points
"You surprised us" Go to track Or 20 points
"You surprised us" Go to track or 20 points
"I didn't know you know our President" 20
"I didn't know you know our President" 20
"I didn't know you know our President" 20
"We didn't know you know our President" 20
"We didn't know you know our President" 20
"We've had reports of improvement" 20
"We've had reports of improvement" 20
No points. No reason. 0
No points. No reason. 0
No points. No reason. 0
No points. No reason. 0
No points. No reason. 0
"We want you to stop talking about other people." 0
"You have been heard complaining to coworkers frequently." 0
"You make insinuations about people." 0
"You discuss your personal problems on company time." 0
"We'd like you to clean up your office." 0
"A couple of different people heard you belching in your booth.
We'd like you to show more discretion." −5
"You are so critical and argumentative. Is there a problem." −5
"Several people have said you take long coffee breaks. " −5
"You seem impatient with co-workers." −5
"We'd like you to be less frank with people." −5
"We understand you stare at coworkers a lot. It's troubling to a bunch of them" −5
"You seem irritated when I give you work. That's right." −5
"Several people have said you have no tact." −5
"You are psyching out your coworkers and it makes a few people uncomfortable."−5
"You don't seem happy. We never see you smile." −5
"Somebody said you've been sneaking out early" −5
"We think you are doing too much visiting" −5
"I've heard you Interrupt other people with details of your personal life" −5
"You have been noticed sleeping in your booth several times." −5
"Several people have said you discuss your salary." −5

Game Card Comments—Track

"Excellent effort on the President's project." 10
"Excellent presentation to the marketing group" 10
"Impressive report on trends in technology." 10
"Super teamwork in filling in for colleagues" 10
"Positive growth in computer skills and abilities" 10
"Excellent progress in cross training" 10
"Outstanding analysis of advertising budget" 10
"Consistent success in contract negotiations" 10
"Creative solutions to human resources mgmt" 10
"Excellent representation of this company" 10
"Consistent accuracy and speed in doc production" 10
"Continued excellent in building client relations" 10
"Continued success in obtaining new business" 10
"We are so glad you decided to work for us" 10
"You have turned your department around" 10
"Excellent relationships with subordinates" 10
"Superb organization and creativity" 10
"Consistent support of coworkers at all levels" 10
"Excellent media relations" 10
"You are an asset to this company" 10
"You are a credit to this company" 10
"Unfailing respect of employees at all levels" 10
"I can't express our gratitude for your efforts" 10
"Keep up the good work" 10
"Excellent budget plan for the coming year" 10
"I have had so many positive reports about you" 10
"Your strong performance is distinctive" 10
"We are so pleased we hired you" 10
"Your performance is impressive in all areas" 10
"Your work on this project was outstanding" 10
"Excellent customer service" 10
"You explain all sides of every issue at all levels—super management" 10
"Excellent written and oral communications" 10
"Excellent interpersonal skills" 10
"Excellent client relations" 10
"Excellent presentation skills" 10
"Strong and effective negotiator" 10
"Successful management of people at all levels" 10
"Excellent work with the public" 10
"Excellent planning and organization for your department" 10
"Excellent workflow management" 10
"Excellent sales results" 10
"Excellent public speaking abilities" 10
"No turnovers in your department for five years. Excellent work." 10
"Excellent service to field offices" 10
"Successful initiation of the 360-review at all levels" 10

"Further training will be required. We know you will improve by the next review" 0

"Further training will be required. We know you will improve by the next review" 0

"Further training will be required. We know you will improve by the next review" 0

"Further training will be required. We know you will improve by the next review" 0

"Further training will be required. We know you will improve by the next review" 0

"Further training will be required. We know you will improve by the next review" 0

"Staff turnover under your management has been high. We need to talk." −20

"The strict division of labor and uneven workloads in your department have been criticized. Can you explain your thinking." −20

"You went too far and you jeopardized the reputation of this firm. We want you to rethink this." −20

"You allowed your personal life to interfere with a critical project. We need to discuss how this might have been better handled." −20

"We want you to explore all sides of every issue in your department regardless of personal friendships. I want to see improvement here." −20

"Your background is outstanding, but we haven't been able to understand what you do all day. Can we talk." −20

"We know you have been applying for other positions and that tells us you don't want to work here. Is there a problem" 0

"We have decided to eliminate your position. That's right," 0

Operation Of Invention—Preferred Embodiment

Players throw a die 24 to determine which path they will travel and therefore which type of boss comments they will receive during their performance review If a player throws a six, he will move to the Track office 36. If a player throws a one, he will move to the Trek office 30. Since a player must throw either a six or a one to get in the game, some players will get into the game before others. Not all players have to be in the game for the game to proceed.

Once players have thrown a six or a one and are in either the Trek office 30 or the Track office 36, they continue to throw one die in turn. The number on the die tells them how many spaces to advance their game pieces 26 over their respective paths.

During travel on the Track 34, if a player lands on a Track space marked with "TEN POINTS", he adds ten points to his accumulated values. He does this by adding one of the ten point cards 20 to his hand 22. If a player lands on a Track space marked "RISK", he selects a card from the top of the stack of Track boss comment cards 14. The player adds this card to his or her hand 22.

During travel on the Trek 28, players pick a card from the top of the stack of Trek game cards 16 at every stop and add it to their hand 22. One of these cards may provide an opportunity for the player to move to the Track path or earn 20 points. If the Trek player decides to move to the Track, that player returns all accumulated Trek boss comment cards to the bottom of the pile of existing Trek boss cards and moves to the waiting room of the Track path. If the Trek player decides to take the 20 points, that player adds one of the 20-point cards 18 to his hand.

Many times, several players are on the same comment path over the game. If a player lands on a space occupied by another player, that other player is bumped back to the waiting room. That bumped player returns any comment cards he or she might have back to the original stack of cards.

As players approach home 40, they must throw the exact number on the die that will propel them into the home space 40. As an example, if a player is on the last space of either the Trek 28 or the Track 34 he or she needs a one to get home. If players throw a number that is too big or too small, they move nowhere. They continue to throw in turn until they throw the exact number that will get them home. All players who make it home automatically get 20 extra performance points, and their performance review for the game is tallied. Players get their 20 points by adding one of the 20-point cards 18 to his or her hand.

A player who reaches Home, combines the values in his or her hand and determines his or her performance review, but does not reveal the review to other players and doesn't leave the game yet. This home player continues to throw a die in turn and his or her play will affect the one player who is closest to the home space regardless of which path that player is on. The home player's play will force existing path travelers into an additional risk situation in which they lose one of their performance review comments and select another. This could be either positive or negative. This feature is referred to as a "card change" and is described in the following paragraphs.

If a home player throws a 6 and the nearest-to-home player is on the Track, the home player immediately selects a card from the hand of this nearest Track player. Home player does this by having such nearest player hold up his or her hand with the backsides facing home player so home player can't distinguish the value or comments on any of the cards in the hand. The home player puts the selected card to one side. The nearest-to-home player then picks another card from the top of the Track boss comment cards to replace the card he or she lost.

If a home player throws a 1 and the nearest to home player is on the Trek, the home player selects a card from the nearest Trek player. The selected card is put aside and the player who lost a card picks a new card from the top of the same stack.

If the home player doesn't throw a 6 or a 1, a card change does not take place. Play moves on to the next person. Also, if a home player throws a 1 or a 6 and there are no players on the paths (perhaps they are in the office area waiting to get on the path in their next throw), a card change does not take place.

As an example of the card change feature, player A makes it home and determines his or her performance review for the game. Player A stays on the home space and game play continues. When it is the turn of player A again, player A throws a 2. He or she does nothing. Play moves on to the next person. When it is the turn of player A again, player A throws a 6. He or she looks over the game board and sees that of players B, C, and D who are still on the traveling paths, player D is the player nearest to home. Player D happens to be on the Track. Player D then holds up his hand with the backsides facing home player A who then selects a card and puts the card to one side. Player D then picks a card from the top of the Track boss stack to replace the lost card. Play moves on to the player who is next in sequence after home player A. This next player could be player D who was just subject to the card change.

The player closest to a home player may change (as other players overtake him or her). In such case, the home player who throws the appropriate number selects a card from the new player who has become the player closest to him or her.

There will never be more than one player occupying the home space 40. That is because home players replace each other. That is, each player who makes it home is replaced by the next player to make it home. That new home player assumes the vacated role of throwing to influence the performance reviews of players who are still on the paths. Replaced home players settle back and wait for the rest of the players to receive their performance review comments.

Players who are nearest to home on either path can protect themselves from the possibility of having to make a card change. If they throw either a 1 or a 6 in their turn (a 1 for a trek path player and a 6 for a track path player), the impressed home player will step aside and immediately retire from the game and cease throwing in order to effect a card change with anyone. If possible, the nearest-to-home players who threw either a 1 or 6 will also move around the board that same number of spaces and also do whatever is dictated by the space upon which they land. As an example, in one play, a nearest-to-home player who is on the Trek could throw a 1, thus causing a home player to step aside. The Trek player would then move one space along the Trek path; and upon landing would pick a boss card. In another example, a nearest-to-home player on the Track who is two spaces from home could throw a 6, thus causing a home player to step aside. Since a 6 is too high to get the Track player home, he or she moves nowhere. As a third example, a nearest-to-home player on the Track who is ten spaces from home could throw a 6, thus causing a home player to step aside. That player would also advance six spaces along the Track path, and upon landing on a space do whatever was dictated by that space (i.e. gain ten points or pick a game card).

The number 1 is associated with the Trek path. At game start, a 1 gets a player on the Trek. A home player needs a 1 to be able to select a card from the nearest player who is on the Trek. A 1 by a nearest-to-home Trek player removes a home player who is exercising his card selection rights. The number 6 serves the same purpose for the Track. At game start, a six gets a player on the Track. A home player needs a 6 to be able to select a card from the nearest player who is on the Track. A 6 by a nearest-to-home Track player removes a home player who is exercising his card selection rights The game ends when the last player reaches home 40 and gets his performance review. At that time, all players will show their hands 22 and reveal their performance reviews. The winner is the player with the highest performance, regardless of which comment path he traveled.

The game also ends in the event there is only one player on the board. This means the game ends if (1) there isn't a player who is still on the home space, and (2) only one player remains on a traveling path, and (3) such remaining player on the path throws a number that cannot advance him or her on the path or get him or her into the home space. The player who didn't make it home combines his values and does not include the twenty points that home players get.

Description of Invention—One Path Version

FIG. 8A is a general representation of a one-path game board 44. There are 70 spaces on the one path 46. Forty-five of the path spaces contain an image of a boss or evaluator. Twenty-five of the spaces are marked with a positive performance review comment and "Ten points". FIG. 8B is a path section 46. The contents of the path spaces face the outer edges of the game board.

FIG. 8C is a view of one 120-card stack of game cards that are used as a means of delivering performance review comments and comment values. These are comprised of the Track cards 14 and the Trek cards 16 combined into one stack and renamed "Boss" cards 48. The comment on three of the Trek cards 16 that says "Opportunity—Go to Track or 20 points" is revised to say "Opportunity—20 points". Other than this change, the performance review comments are the same.

FIGS. 8D to 8E are views of both sides of a 10-point card 50. These are comprised of the 10-point cards 20 with the word "Track" on one side changed to the word "Boss".

An ordered list of the one-path contents from the first playing space next to the waiting room to the last space follows:

One-Path Version

1. Boss face
2. Eager to learn 10 points
3. Boss face
4. Boss face
5. Boss face
6. Enthusiastic 10 points
7. Boss face
8. Boss face
9. Initiative 10 points
10. Conscientious 10 points
11. Leader 10 points
12. Boss face
13. Boss face
14. Curious and questioning 10 points
15. Boss face
16. Boss face
17. Boss face
18. Ethical 10 points
19. Boss face
20. Boss face
21. Fair 10 points
22. Boss face
23. Hardworking 10 points
24. Boss face
25. Boss face
26. Boss face
27. Dedicated 10 points
28. Boss
29. Computer whiz 10 points
30. Boss face
31. Boss face
32. Boss face
33. Articulate 10 points
34. Boss face
35. Boss face
36. Enthusiastic 10 points
37. Boss face
38. Boss face
39. Boss face
40. Mentor 10 points
41. Boss face
42. Boss face
43. Boss face
44. Boss face
45. Boss face
46. Team player 10 points
47. Boss face
48. Professional with all 10 points
49. Boss face
50. Boss face
51. Boss face 52. Positive 10 points
53. Hardworking 10 points
54. Team player 10 points
55. Boss face
56. Creative 10 points
57. Boss face
58. Share knowledge 10 points
59. Leader 10 points
60. Boss face
61. Boss face
62. Action oriented 10 points
63. Boss face
64. Boss face
65. Boss face
66. Boss face
67. Boss face
68. Breadth of knowledge 10 points
69. Boss face
70. Multiple skills 10 points Operation of Invention—One Path Version Players need to throw a six in order to get in the game and on the single comment path 46. Upon landing on an image of a boss, players pick a boss comment card 48. Upon landing on a ten-point comment, players pick a ten-point card 50

A home player needs to throw a six to effect the card change described for the Preferred Embodiment. Players who are subject to a card change (i.e. the player nearest to such home player and still on the board) may, by throwing a six, stop the home player from using the card change feature.

Description of Invention—One Path Version (All Boss Faces)

FIG. 9A is a general representation of the one-path game board 52. There are 40 spaces on the one path that each include the face of a boss or evaluator.

FIG. 9B is a path section 54. The contents of the traveling spaces face the outer edges of the game board.

FIG. 9C is a view of one 120-card stack of game cards that are used as a means of delivering performance review comments and comment values. These are comprised of the Track cards 14 and the Trek cards 16 combined into one stack and renamed "Boss" cards 48. The comment on three of the Trek cards 16 that says "Opportunity—Go to Track or 20 points" is revised to say "Opportunity—20 points". Other than this change, the performance review comments are the same.

There are no ten-point cards in this version.

Operation of Invention—One Path Version (All Boss Faces)

Players need to throw a six in order to get in the game and on the single comment path 54. Upon each landing, players pick a boss comment card 48.

A home player needs to throw a six to effect the card change between a home player and a still-traveling player described in the operation of the Preferred Embodiment. Players who are subject to a card change (i.e. the player nearest to such home player and still on the board) may, by throwing a six, stop the home player from using the card change feature.

Description of Invention—One Path Version (No Boss Comment Cards)

FIG. 10A is a general representation of the game board 56. There are 62 spaces on the one path 58. Each space includes an image or representation of a boss, a performance review comment, and comment value. FIG. 10B is a path section 58. There are no boss comment cards in this version.

The contents of the traveling spaces face the outer edges of the game board. An ordered list of the playing spaces and contents follows:

One Path. Version (No Boss Comment Cards)

1. "You burst into people's offices" Deduct 10 points
2. "We feel your time management needs improvement" Deduct 10 points
3. "You share your knowledge" Ten points
4. "Some of your work habits seem inefficient and unproductive" Deduct 10 points
5. "You are eager to learn" Ten points
6. "You are late too often" Deduct 10 points
7. "I believe you know the president personally" Twenty points
8. "Constantly upgrading your skills" Ten points
9. "There's just too much gossiping" Deduct ten points
10. "You have to stop asking new employees about their sexual habits" Deduct ten points
11. "You have multiple skills" Ten points
12. "You are professional with everybody" Ten points
13. "You don't complete your projects" Deduct ten points
14. "You are too dependent on the assistance of others" Deduct ten points
15. SEEN TALKING TO PRESIDENT Ten points
16. "You are so articulate" Ten points
17. "You make too many mistakes" Deduct ten points
19. SPECIAL PROJECT done well Twenty points
20. "You are innovative" Ten points
21. "Excellent interpersonal skills" Ten points
22. "Your performance is disappointing" Deduct ten points
23. SEEN TALKING TO PRESIDENT Twenty points
24. "You stare at coworkers" Deduct ten points
25. "You are creative" Ten points
26. SPECIAL PROJECT, done well Twenty points
27. "You don't follow instructions" Deduct ten points
28. SPECIAL PROJECT, done well Twenty points
29. "You've been seen sleeping during work hours" Deduct ten points
30. "You have developed new methods of doing business that we appreciate" Ten points
31. "You never volunteer to help others" Deduct ten points
32. "You have such a breadth of knowledge" Ten points
33. SPECIAL PROJECT, done well Twenty points
34. "You are a mentor" Ten points
35. "You have been heard belching loudly in your booth" Deduct ten points
36. "You are full of new ideas" Ten points
37. "You don't produce as much work as we expected" Deduct ten points
38. "You organized company wide training programs that have improved morale." Ten points
39. "We want you to try and get to work on time" Deduct ten points
40. "You are a team player" Ten points
41. "You are too frank with people" Deduct ten points
42. "You never volunteer to help out" Deduct ten points
43. "We can always depend on you to train other employees" Ten points
44. "You are too critical of coworkers" Deduct ten points
45. "You don't seem to use manners when you interact with others" Deduct ten points
46. "You are so articulate" Ten points
47. "You ask too many personal questions" Deduct ten points 48. "You are bad mannered" Deduct ten points
49. "You are fully skilled in several positions" Ten points
50. "You've got to stop bringing your animals to work" Deduct ten points
51. "You have been making just too many personal phone calls on company time" Deduct ten points
52. SPECIAL PROJECT, done well Twenty points
53. "You are always fair" Ten points
54. "You seem to get irritated when. I give you work" Deduct ten points
55. "You discuss your intimate life with Deduct ten points coworkers"
56. "You take long coffee breaks" Deduct ten points
57. "Great results troubleshooting software problems" Ten points
58. "We'd like to see you use a little more tact with your coworkers and the executive staff" Deduct ten points
59. SEEN TALKING TO PRESIDENT Twenty points
60. "Many of your coworkers have mentioned body odor" Deduct ten points
61. SEEN TALKING TO PRESIDENT Twenty points
62. "Excellent interpersonal skills" Ten points

Operation Of Invention—One Path Version (No Boss Comment Cards)

Players need to throw a six in order to get in the game and on the single comment path 58. At travel path landings, players read and record the performance review comment and points that are indicated on the path. Players may record their own comment points using notepaper and pencil or select a particular player to record points for all players during the game.

When a player reaches the home space, that player adds 20 points to his or her accumulated values for the game. This player then retires from the game to wait for other players to get their performance reviews.

The game ends when there is only one player on the game path and that player throws a number that is too high to get him or her directly into the home space. At that point, this remaining player combines the values of his comments to determine his or her final performance review. Since this player doesn't make it to the home space, he or she does not get the additional twenty points.

CONCLUSIONS, RAMIFICATIONS, AND SCOPE

Accordingly, the reader will see that the board game of this invention provides a) a novel performance review board game based on job performance reviews conducted in businesses and organizations that provides an experience similar to sitting in a boss' office and getting a performance review, b) a board game designed to showcase boss power, and boss management skills and temperament;

c) a board game of recognition and learning for all people who have experienced job performance reviews, including those who are bosses;

d) a board game that will familiarize young people with elements of the "performance review" workplace tool they will probably encounter in their working lives;

e) a performance review board game that is simple to learn, inexpensive, and easy to enjoy in a spirit of fun and companionship.

While my above description contains many specificities, these should not be construed as limiting the scope of the invention, but as merely providing illustrations of some of the presently preferred embodiments of the invention. For example, board path or paths could be in different sizes or shapes, the number of spaces and the number of boss comments could be different; boss comments can be changed to be more specialized or devoted to those appropriate for particular field or profession so that the game itself is a specialized edition (i.e. computers or law) or they could reflect comments suitable wholly for very young children; comment values could be changed; boss images can be greatly exaggerated to show a range of facial or body expressions or bosses could be displayed as cute animals that might represent certain emotions or types (i.e. rats, rabbits, lions, lambs, eagles, cats); and dice could contain different number designations.

Accordingly, the scope of the invention should be determined not by the embodiment(s) illustrated, but by the appended claims or their legal equivalents.

Figures

Figure 2A:
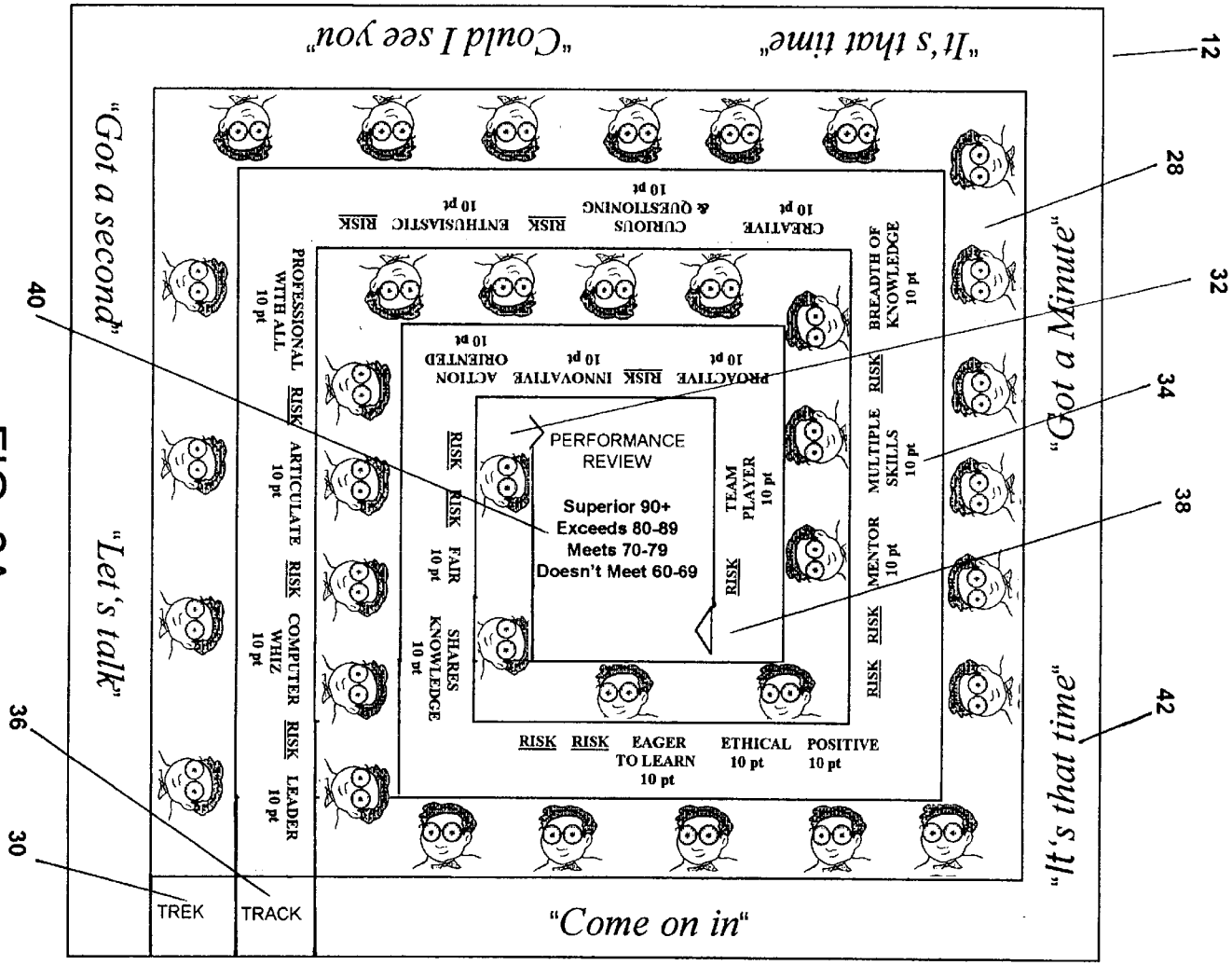
FIG. 2A is an exploded view of the board game shown in FIG. 1.
Figure 2B:
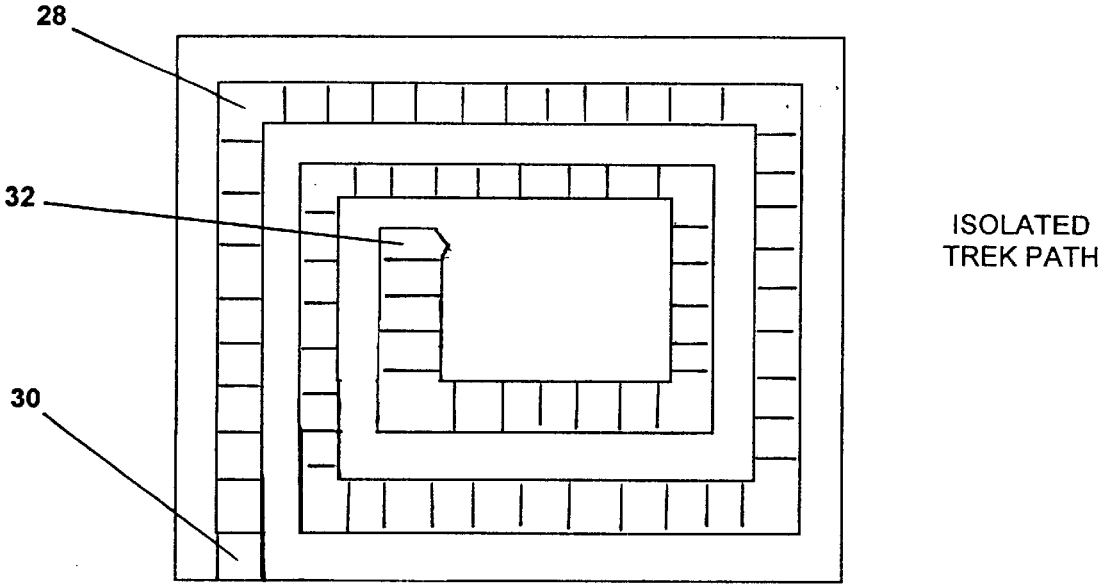
FIGS. 2B to 2E show an isolated view of the Trek path, and, enlarged views of a section of the Trek, the Trek office, and the last space of Trek showing a directional arrow to indicate the next stop is home.
Figure 2C:
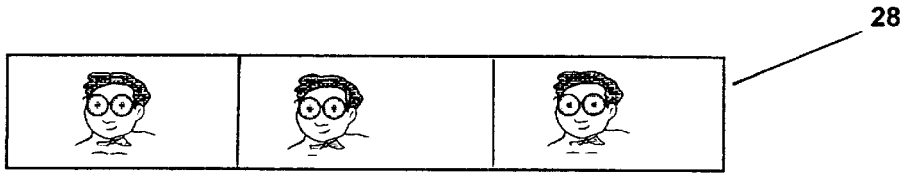
Figure 2D:
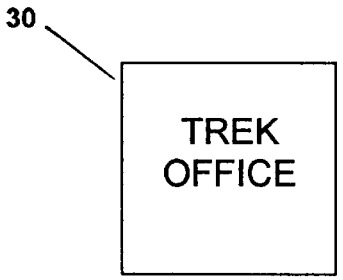
Figure 2E:
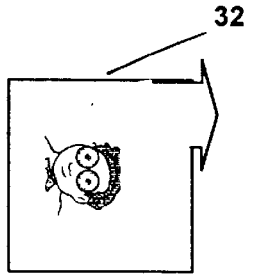
Figure 2F:
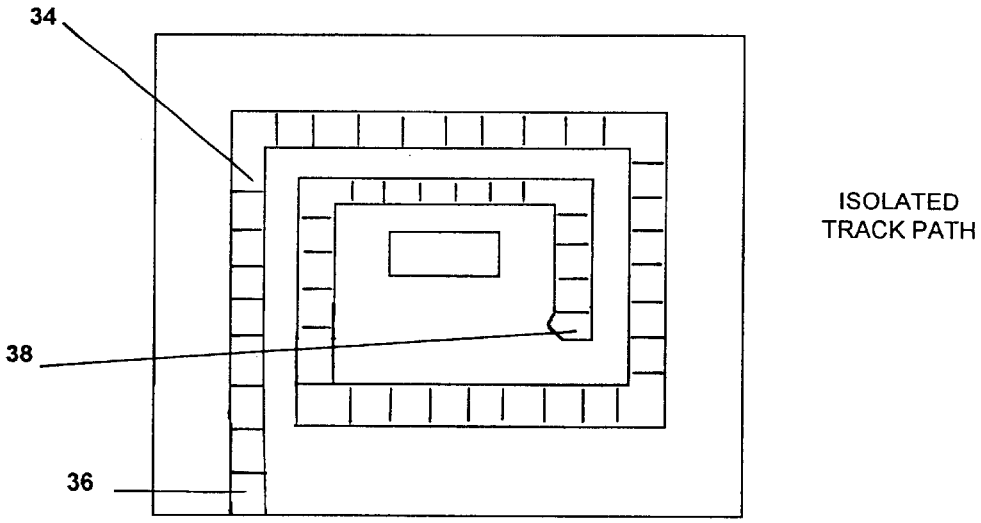
FIGS. 2F to 2I show an isolated view of the Track path, and enlarged views of a section of the Track, the Track office, and the last space of Track showing a directional arrow to indicate the next stop is home.
Figure 2G:
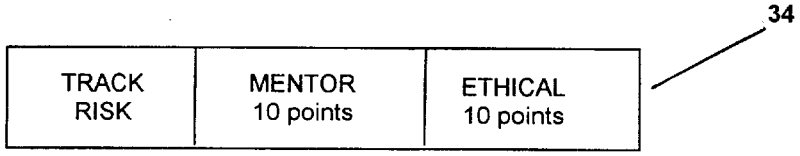
Figure 2H:
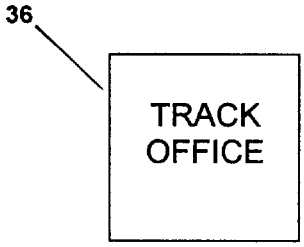
Figure 2I:
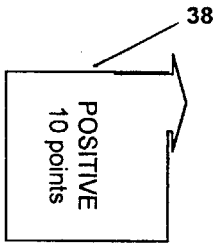
Figure 2J:
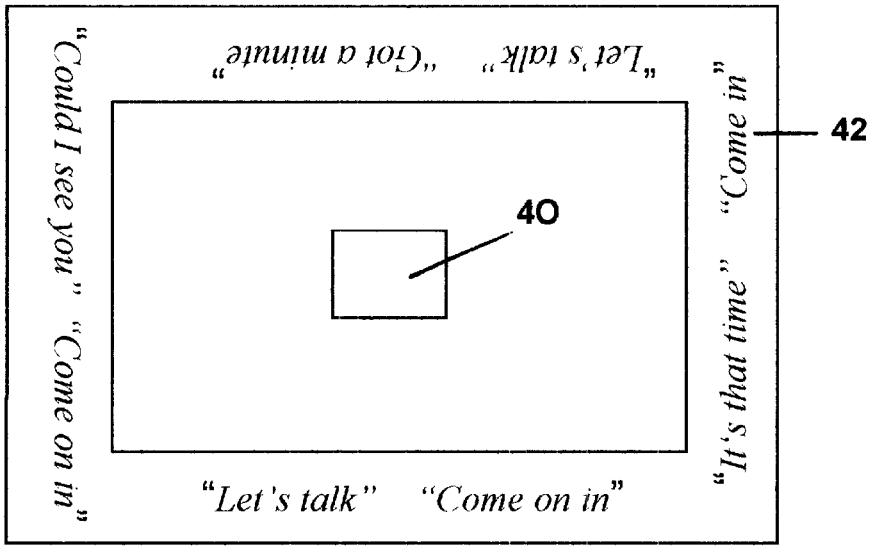
FIGS. 2J to 2L show further aspects of the game board which include an isolated view of the outer area and an enlarged section of such outer area, and an enlarged view of the center home space.
Figure 2K:
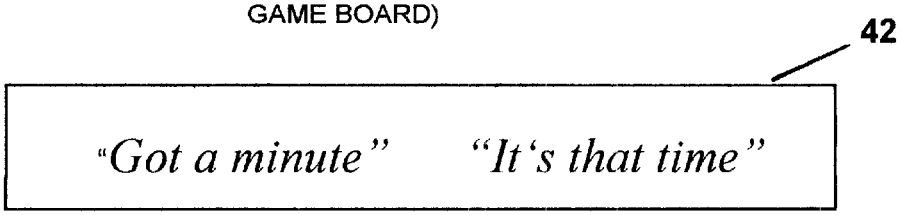
Figure 2L:
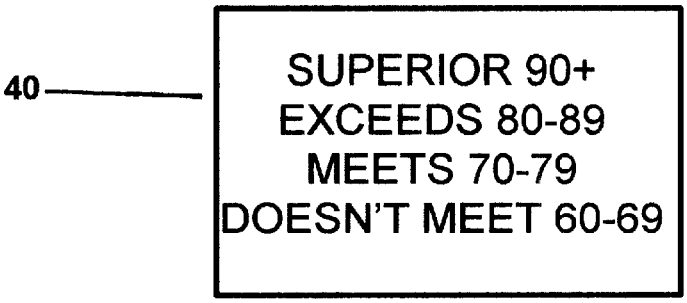
Figure 3A:
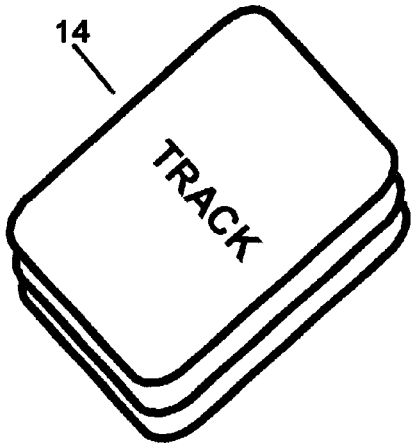
FIGS. 3A to 3E are views of the Track boss comment cards and include an illustration of one side of an exemplary Track card and four illustrations of a reverse side of an exemplary Track card.
Figure 3B:
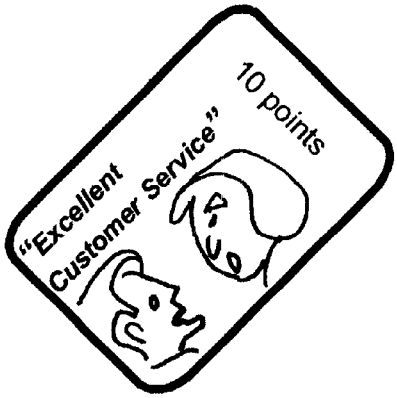
Figure 3C:
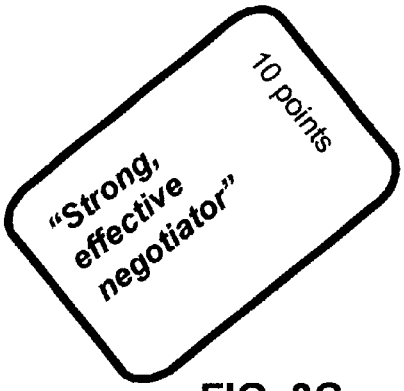
Figure 3D:
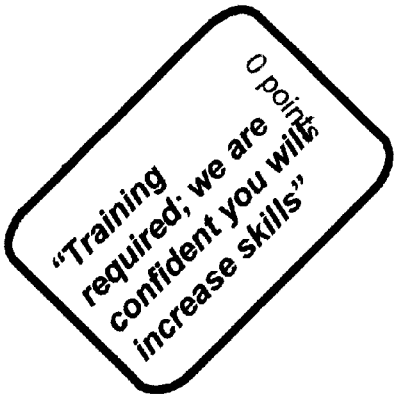
Figure 3E:
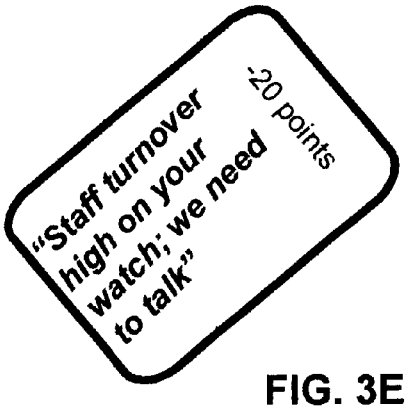
Figure 4A:
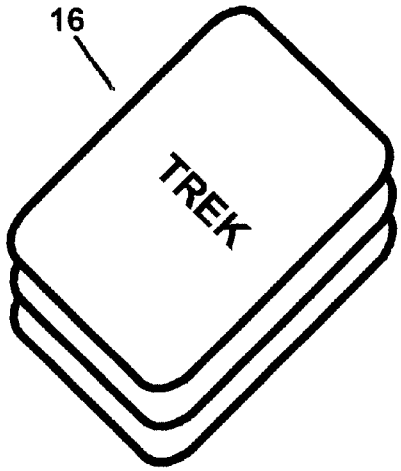
FIGS. 4A to 4E are views of the Trek boss comment cards and include an illustration of one side of an exemplary Trek card and four illustrations of reverse sides of exemplary Trek cards.
Figure 4B:
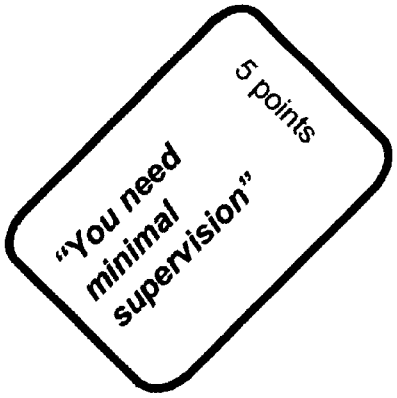
Figure 4C:
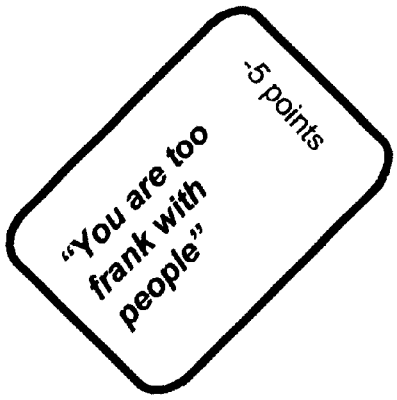
Figure 4D:
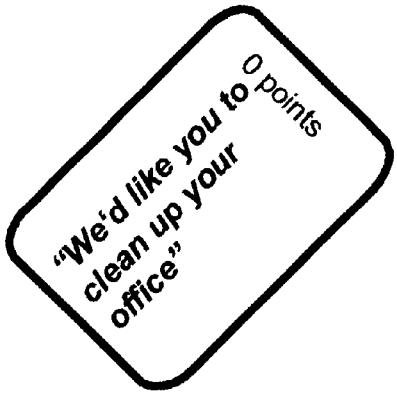
Figure 4E:
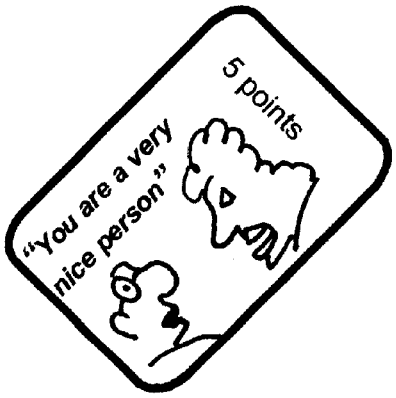
Figure 5A:
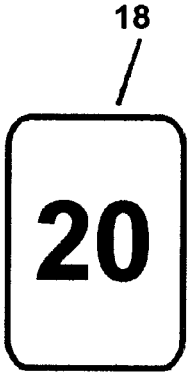
FIGS. 5A to 5D are views of a 20-point card and a 10-point card.
Figure 5B:
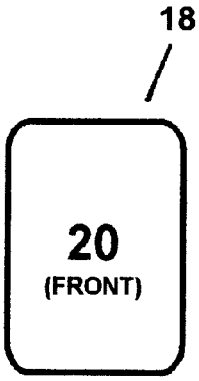
Figure 5C:
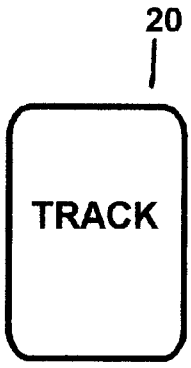
Figure 5D:
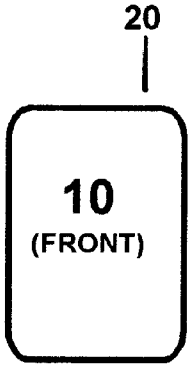
Figure 6:
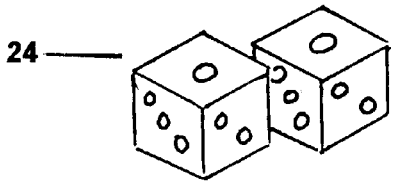
FIG. 6 is a perspective view of a die
Figure 7:
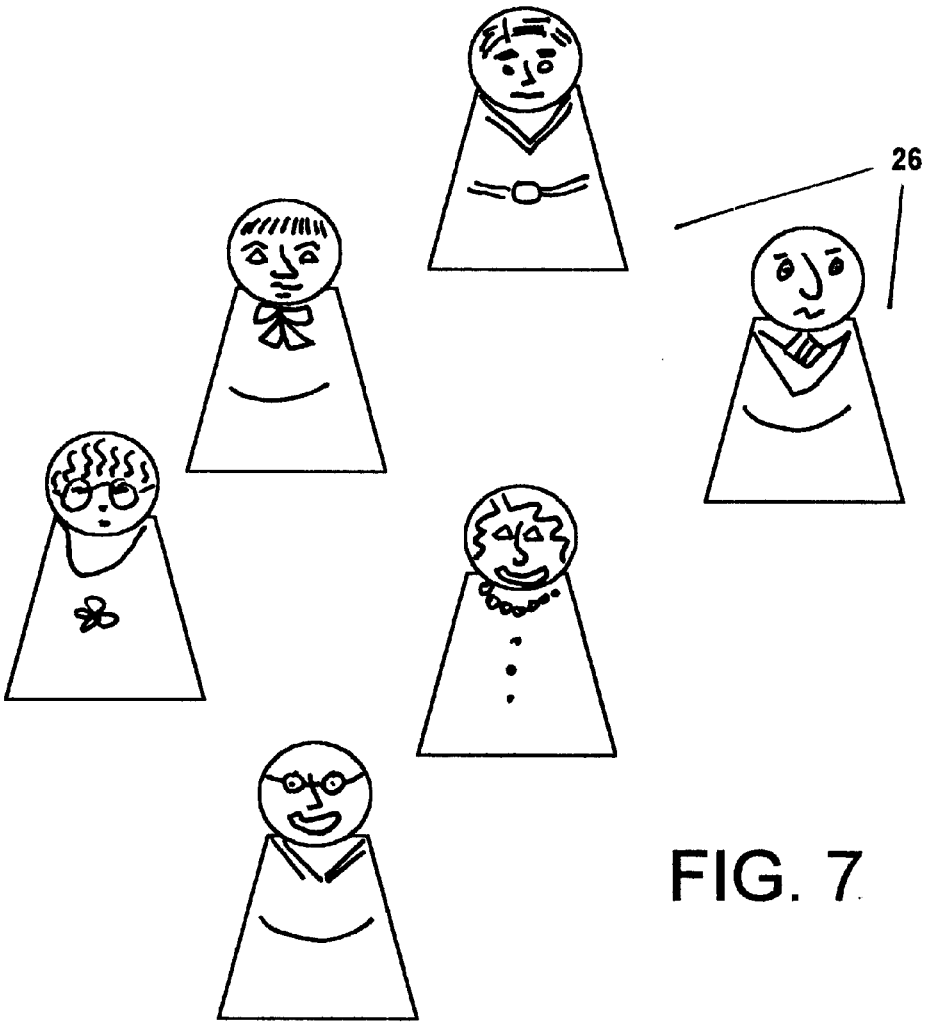
FIG. 7 is a perspective view of the game pieces

Figure Figures—Preferred Embodiment
1A General view of all components plus way of holding game cards
2A Exploded view of board of FIG. 1A
2B Game board with isolated Trek path
2C Part of Trek path enlarged
2D Enlarged Trek office
2E Enlarged Trek last space
2F Game board with isolated Track path
2G Part of Track path enlarged
2H Enlarged Track office
2I Enlarged Track last space
2J Outer area of board isolated
2K Enlarged board outer area
2L Close up of board center space
3A Example of Trek boss comment card, one side
3B Example of Trek boss card, reverse side
3C Second example of Trek boss card, reverse side
3D Third example of Trek boss card, reverse side
3E Fourth example of Trek boss card, reverse side
4A Example of Track boss comment card, one side
4B Example of Track boss card, reverse side
4C Second example of Track boss card, reverse side
4D Third example of Track boss card, reverse side
4E Third example of Track boss card, reverse side
5A Example of one side of 20-point home card
5B Example of reverse side of 20-point card
5C Example of one side of Track 10-point comment value card
5D Example of reverse side of Track 10-point card
6 Dice
7 Game pieces
Figure Figures—One Path Version
8A General view of game board, showing single path
8B Enlarged view of section of travel path
8C View of a single stack of boss comment cards
8D Example of 10-point comment value card
8E Example of reverse side of 10-point card
Figure Figures—One Path Version (All Boss Images)
9A General view of game board, showing single path
9B Enlarged view of section of travel path
9C View of a single stack of boss comment cards
Figure Figures—One Path Version (No Boss Comment Cards)
10A General view of game board
10B Enlarged view of section of travel path

Drawing Reference Numerals

Game board 12
Track boss comment cards 14

Trek boss comment cards 16
Twenty-point game cards 18
Ten-point game cards 20
Hand of game cards 22
Dice 24
Game pieces 26
Trek path 28
Trek office 30
Trek last space 32
Track path 34
Track office 36 Home space 40
Track last space 38 Board border 42
One Path Version
Game board 44
Single path and path section 46
Single stack of Boss cards 48
Ten-point cards 50
One Path Version (All Boss Faces)
Game board 52
Single path and path section 54
Single stack of Boss cards 48
One Path Version (No Boss Comment Cards)
Game board 56
One path and path section 58

I claim:

1. In a method of play of a board game of the type comprising (a) a game board marked with a game course having a plurality of playing spaces, (b) a plurality of game pieces representing players, (c) a collection of game cards, and (d) a chance device, the improvements in combination:

A) Providing a game board wherein said plurality of playing spaces include faces or representations of bosses or evaluators, B) Providing a collection of game cards including job performance review comments made by bosses that replicate those given to employees in the work-place and values pertaining to such comments, and including value cards that are the same size as said boss comment cards, whereas such value cards can fit into a hand of cards as mentioned below, C) Determining order of play, D) Players in turn moving said game pieces over a certain number of such spaces of said game course as determined by said chance device, E) Each player at stops on said spaces selecting one of said game cards and forming a private hand of cards and when selecting comment cards doing so from one stack of comment cards, F) Combining such game cards to determine a final performance review rating upon completion of travel over said game course, whereas players do not repeat travel over same game course to gain further comments and thereby determine a performance review, G) All players completing travel over said game course before game ends, whereas if one player completes travel over a game path before other players, game play continues until all other players complete their own individual travel over one path and whereas first person to complete travel doesn't necessarily win game, H) Home players in turn selecting a game card from the collected cards (the private hand) of another player still en route and such player en route selecting another card from said collection of game cards to replace such lost card, whereas players who make it home early have opportunity to influence the performance review of players who are still en route, whereas all players travel over a path signifying time spent with a boss getting a private performance review for work that is assumed to have been done, and such performance review is delivered in the form of a hand of cards.

2. The game of claim 1 wherein said game board further includes a plurality of performance review levels for classifying the job performance of employees according to total combined values of boss comments, and wherein there is included a further step of I) Comparing such total values to such performance review levels to determine a final performance review rating.

3. The game of claim 2 including the further step of

J) Declaring the player (or players) with the highest performance review level the winner(s).

4. The game of claim 2 wherein said performance review levels include the levels of Superior, Exceeds Expectations, Meets Expectations, Doesn't Meet Expectations.

5. The game of claim 1 wherein said boss performance review comment values are a certain number of performance review points.

6. The game of claim 1 wherein said game board further includes a plurality of typical welcoming comments that are made by bosses to initiate a performance review experience.

7. The game of claim 1 wherein said game course comprises two separate paths that each represent a different kind or quality of performance review, and wherein there is included a further step of K) Determining which travel path players will travel.

8. The game of claim 7 wherein said two separate paths lead to a common home space.

9. The game of claim 7 in which each of said two paths has a unique starting space.

10. The game of claim 7 wherein said boss comment cards comprise two stacks, each associated with one of said two said traveling paths and wherein there is included a further step of L) When selecting a game card, selecting a game card from stack associated with said path.

11. The game of claim 10 wherein one of said stacks of game cards includes indicia including boss performance review comments and performance point designations that are generally progressive and positive, and one of said stacks of game cards includes indicia including boss performance review comments and performance point designations that are generally unprogressive and negative.

12. The game of claim 1, wherein there is the further step of

M) Players reaching home space replacing players who reached home space before them, whereas there is one player on home space at a time and able to effect card exchange described herein.

13. The game of claim 1, wherein there is the further step of

N) Players, in their turn, while traveling said board preventing home players from forcing a card exchange by using said chance device to yield a certain predetermined number.

14. A method of play of a board game of the type comprising (a) a game board marked with a game course having a plurality of playing spaces comprising indicia and images, (b) game cards, (c) a plurality of game pieces representing players, (d) and a chance device, characterized by A) Providing a game board wherein said indicia and images include boss or evaluator performance review comments and performance review comment values, B) Providing a plurality of game cards including such performance review comment values as are inscribed on said playing spaces, whereas such game cards do not include boss comments, C) Players in turn moving said game pieces over a certain number of such spaces of said game course as determined by said chance device, D) At stops on said traveling path selecting a game card that contains the value inscribed on such stop, and forming a private hand of cards, E) Combining said values to yield a total value upon completion of travel over said game course, whereas players do not repeat travel over same game course to gain further comments and thereby determine a performance review, F) All players completing travel before game ends, whereas if one player completes travel over a game path before other players, game play continues until all other players complete their own individual travel over one path and whereas first person to complete travel doesn't necessarily win game, G) Home players staying in game and in turn selecting a game card from the collected cards (the private hand) of another player still en route and such player en route selecting another card from said collection of game cards to replace such lost card, whereas players who make it home early have opportunity to influence the performance review of players who are still en route, whereas all players travel over a path signifying time spent with a boss getting a private performance review for work that is assumed to have been done, and such performance review is delivered in the form of a hand of cards.

15. An improved method of play of a board game of the type comprising (a) a game board marked with at least one path to a home space over which players move game pieces, (b) game pieces representing players, (c) a chance device, and (d) a plurality of game cards, comprising in combination A) Providing a game board wherein said path or paths are lined with faces or representations of bosses or evaluators, B) Providing said plurality of game cards as means of delivery of boss comments to players, and in event of multiple paths providing a stack of boss comments cards for each path, whereas such comments relate to prior activities and reflect comments of a boss to an employee that might be delivered in the work-world after a word period has been completed, C) Providing each player with one game piece that represents the player, whereas there are no other moveable representations of players such as contestant cards, D) Determining order of play, E) Players moving said game pieces over said game board as determined by said chance device, whereas spinning and pointing devices are not employed to influence game play, F) At stops on said boss images, players selecting a game card, and adding it to their hands of cards and keeping such hands private until game ends, G) Players combining cards from travel over one path to determine a performance review, regardless of a board that has multiple paths, H) All players completing travel on one path before game ends, whereas if one player completes travel over a game path before other players, game play continues until all other players complete their own individual travel over one path and whereas first person to complete travel doesn't necessarily win game, I) Home players staying in game and in turn selecting a game card from the collected cards (the private hand) of another player still en route and such player en route selecting another card from said collection of game cards to replace such lost card, whereas players who make it home early have opportunity to influence the performance review of players who are still en route, whereas all players travel over a path signifying time spent with a boss getting a private performance review for work that is assumed to have been done, and such performance review is delivered in the form of a hand of cards.

16. The game of claim 15 including the further step of:

J) Players, in their turn, while traveling said board preventing home players from forcing a card exchange by using said chance device to yield a certain predetermined number.

* * * * *